US005165216A

United States Patent [19]

May et al.

[11] Patent Number: 5,165,216

[45] Date of Patent: Nov. 24, 1992

[54] LOOP FORMING MECHANISM FOR FLEXIBLE PACKAGING MATERIAL

[75] Inventors: Dennis J. May, Moncure Township, Chatham County; David J. Moore, Garner; James H. Ohlinger, Raleigh; Samuel H. Arnold, Apex, all of N.C.

[73] Assignee: Delaware Capital Formation, Inc., Apex, N.C.

[21] Appl. No.: 776,795

[22] Filed: Oct. 15, 1991

[51] Int. Cl.[5] ..... B65B 61/14; B65B 51/04; B65B 7/06

[52] U.S. Cl. ..... 53/413; 53/417; 53/481; 53/134.1; 53/138.2; 53/138.4

[58] Field of Search ..... 53/413, 479, 481, 138.3, 53/138.4, 134.1, 134.2, 370, 371.2, 370.7, 389.3, 417, 138.2

[56] References Cited

U.S. PATENT DOCUMENTS

| | | | |
|---|---|---|---|
| 2,246,229 | 6/1941 | Wohlmuth | 53/138.3 X |
| 2,718,991 | 9/1955 | Rabinowitz | 53/138.4 X |
| 3,383,754 | 5/1968 | Klenz . | |
| 3,389,533 | 6/1968 | Tipper et al. | 53/134.1 |
| 3,400,433 | 9/1968 | Klenz . | |
| 3,728,773 | 4/1973 | Dobbert . | |
| 4,044,450 | 8/1977 | Raudys et al. | 53/134.1 X |
| 4,165,593 | 8/1979 | Niedecker | 53/138.4 X |
| 4,247,005 | 1/1981 | Buxton | 53/138.4 X |
| 4,642,865 | 2/1987 | Kelem | 53/138.4 X |

*Primary Examiner*—Horace M. Culver
*Attorney, Agent, or Firm*—Allegretti & Witcoff, Ltd.

[57] ABSTRACT

An improved method for packaging utilizes the two-spaced clippers for simultaneously attaching the first and second U-shaped metal clips to gathered packaging material. Prior to attachment of the clips, the tail end of the packaging material is wrapped around a movable sleeve or post which is extended to effect tight packing of the contents of packaging material. The movable post is then released after attachment of the clips. With the invention, it is possible to form a loop or handle using the same material that is used for packaging of a product. Additionally, the construction and method reduces the likelihood of the operator developing carpal tunnel syndrome.

4 Claims, 6 Drawing Sheets

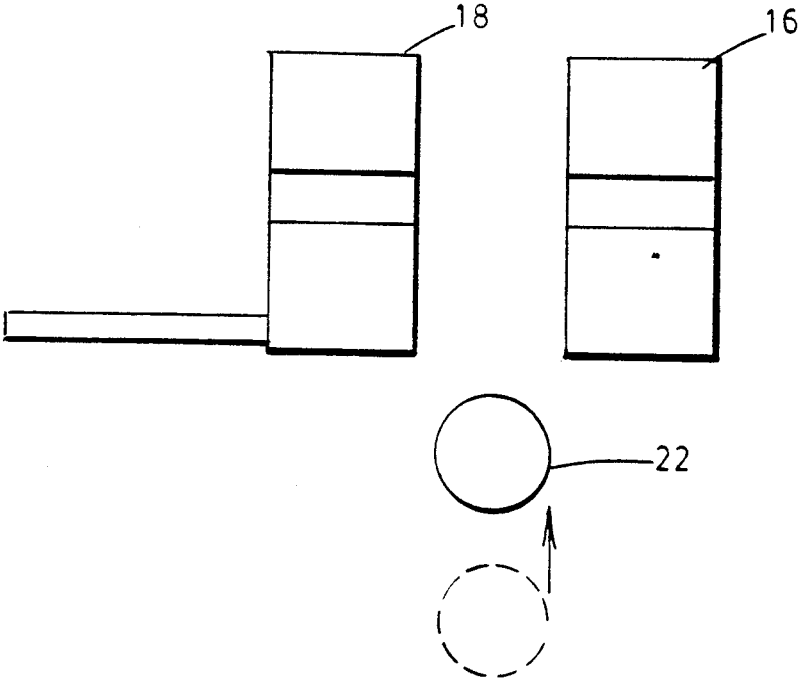
FIG. 5
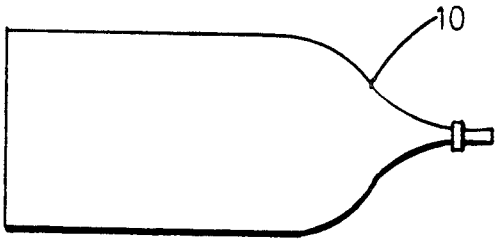
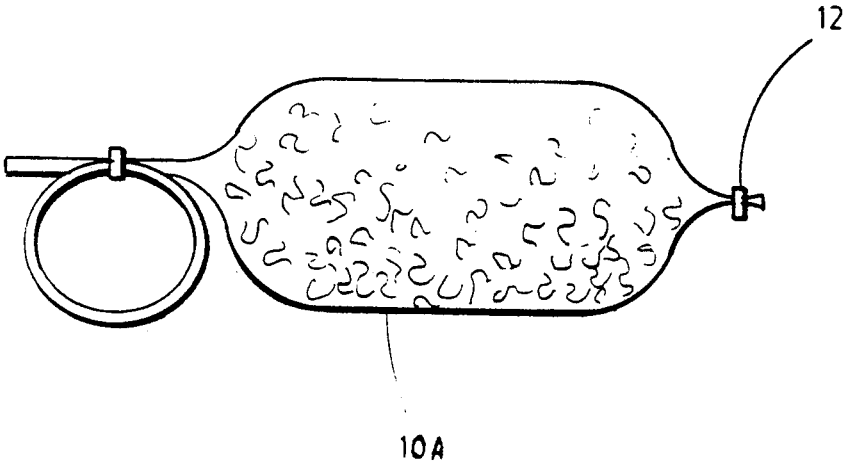

LOOP FORMING MECHANISM FOR FLEXIBLE PACKAGING MATERIAL

BACKGROUND OF THE INVENTION

This invention relates to an improved method and apparatus for forming a loop or handle in flexible packaging material.

Food product packaging often employs a sleeve or casing of flexible packaging material which is clipped or sealed at its opposite ends about the bulk product therein. The procedure for forming the package typically involves placement of the bulk product within a sleeve or tube of flexible packaging material that has been sealed or closed at one end. The sleeve is then tightly drawn about the product and the opposite end is sealed or clipped.

Before the opposite end is sealed, it is often desirable to loop the free end of the packaging material to form a handle to carry or move the product as shown in U.S. Pat. No. 3,383,754. During the packaging operation, however, whether a loop is formed or not, it is necessary to tightly pack the contents of the package within the sleeve of packaging material before sealing the opposite end of the package. Typically, this is done by manually pulling the sleeve containing the product against a stop. Thereafter, some type of fastener, such as a U-shaped metal clip, may be attached about the packaging material.

The manual operation of pulling the product and sleeve against a stop can lead to worker disability, such as carpal tunnel syndrome. Thus, there has developed a need for providing a packaging method and apparatus which will enable a product to be packaged tightly within flexible packaging material with minimum manual effort and which further enables the formation of a loop to be incorporated with the package of flexible material. It is against this background that the present invention was developed.

SUMMARY OF THE INVENTION

Briefly, the present invention relates to an improved packaging method which utilizes a double clipper for attachment of spaced, U-shaped metal clips to packaging material. A movable post is used in combination with the clipper so that the free tail end of the packaging material may be about the post formed as a loop for the packaged product. The loop is attached to the packaging material during the clipping operation and serves as a handle for the package.

More particularly, the present invention utilizes a double clipper comprised of first and second spaced, generally parallel, clip attachment mechanisms which are useful for the attachment of U-shaped metal clips about flexible packaging material that has been gathered in the throats of two clippers. Typically, after the clips are attached to the flexible gathered material, the material between the clippers is severed or cut. The present invention permits such severance or cutting. However, the present invention also provides for the formation of a loop which becomes part of a closed package formed by the clippers. Thus, an extendable post is positioned between the clippers. The method of use provides that the flexible end of the packaging material is fitted through the throat of the first clipper, around the post, through the throat of the first clipper once again and then into the throat of the second clipper. Optionally, the free end of the packaging material may then be wrapped around a second post adjacent the second clipper to lock it into a generally fixed position and thereby eliminate substantially all manual stress on the operator of the equipment. After the free end of the material is arranged about the post and through the throats of the clippers, the bracket supporting the post is extended to thereby extend the post and draw the flexible packaging material through the throat of the first clipper. In this manner, the bulk product is tightly packed within the packing material. The die plate of the first clipper thus acts as a stop. After the flexible netting or packaging material slides through the throat of the first clipper, it may be tightly clipped by operation of the first clipper. Simultaneous operation of the second clipper seals off the end of the packaging material for the next step of the packaging operation. Finally, a knife severs the free end of the packaging material between the two clippers.

Thus, it is an object of the invention to provide an improved method for packaging using flexible packaging material and a clipper assembly of the type which includes two spaced clippers for simultaneously attaching first and second spaced U-shaped metal clips to flexible gathered packaging material.

A further object of the invention is to provide a post construction for use in association with first and second spaced clippers whereby the free end of packaging material may be wrapped around the post and directed through the clippers so that the mounting bracket for the post may be extended to tightly enclose the product or contents of the packaging material.

Yet a further object of the invention is to provide an improved apparatus and method of operation for packaging which significantly cuts down the likelihood of an operator developing carpal tunnel syndrome.

Another object of the invention is to provide an improved method of packaging and apparatus therefore which provides for the formation of a carrying loop from the flexible packaging material simultaneously with tightly packing the contents within the package which is being formed.

A further object of the invention is to provide an improved packaging method and apparatus which efficiently provides for packaging of various products in flexible packaging material.

These and other objects, advantages and features of the invention will be set forth in the detailed description which follows.

BRIEF DESCRIPTION OF THE DRAWING

In the detailed description which follows, reference will be made to the drawing comprised to the following FIGURES:

FIGS. 1 through 5 are a series of schematic drawings which depict the steps which comprise the method of the invention;

Thus, FIG. 1 is a top plan schematic view of packaging material previously clipped or sealed at one end and ready for receipt of a bulk product prior to being clipped at its opposite end;

FIG. 2 is a schematic view similar to FIG. 1 wherein the bulk product has been positioned within the packaging material and the packaging material has been positioned for appropriate engagement with a double clipper;

FIG. 3 is a schematic view illustrating the next step in the sequence of operation of the invention wherein a loop has been formed by passing the packaging material through the first clipper about a post with the tail end of the flexible packaging material also redirected through the first clipper, then fitted through a second clipper and about a second post;

FIG. 4 is a schematic view of the next sequential step wherein the first post associated with the improved method of the invention has been extended to tightly packed the bulk product within its flexible packaging material and clips have been applied to the gathered flexible packaging material just prior to severing of the flexible packaging material between the attached clips;

FIG. 5 is a schematic view illustrating the next step in the sequential operation wherein a flexible package is formed having a loop or handle at one end of the package;

FIG. 10 is a perspective view illustrating the method of the invention; and

FIG. 11 is a further sequential view illustrating the method of the invention.

DESCRIPTION OF THE PREFERRED EMBODIMENT

Figure 1:
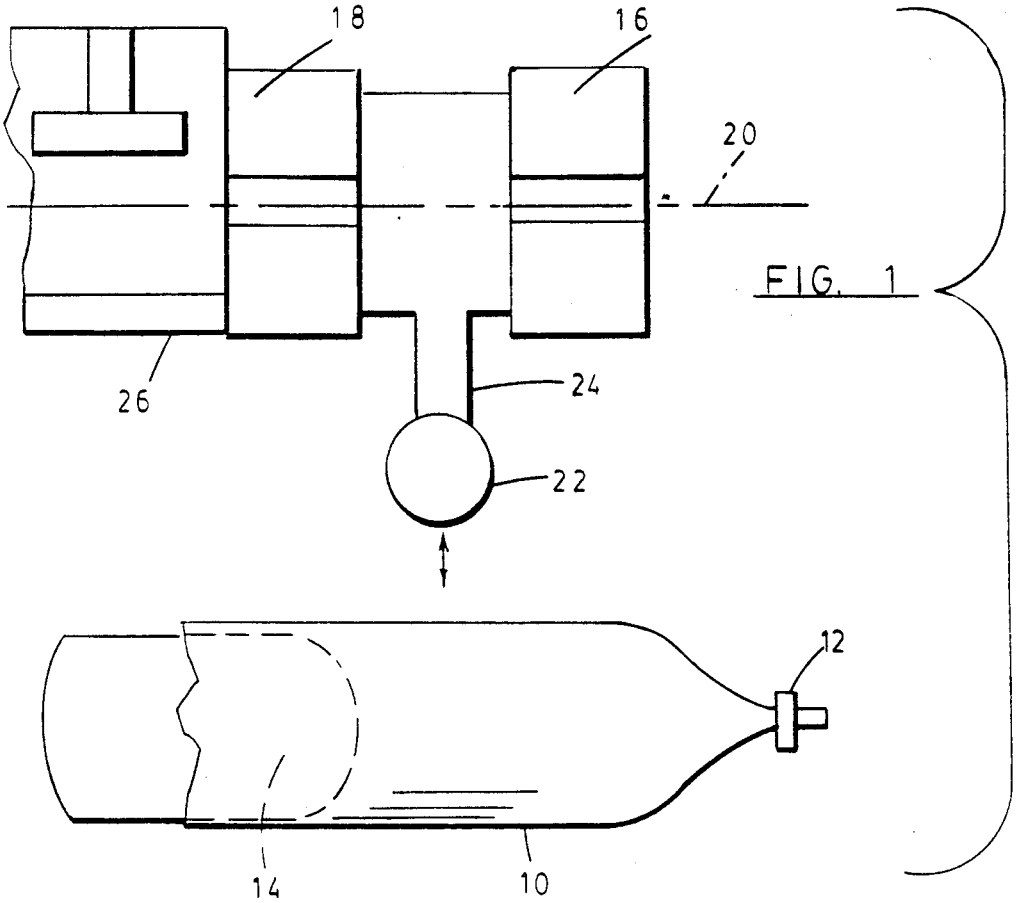

FIGS. 1 through 6 and FIGS. 10 and 11 illustrate schematically the method and apparatus of the present invention. Referring first to FIG. 1, there is illustrated a flexible packaging material 10 which may, for example, be a sleeve of plastic netting or casing material for receipt of a food product, such as a ham or turkey or the like. The flexible packaging material 10 is generally in the form of a cylindrical sleeve or tube. As a first step in the performance of the packaging operation, a clip or seal 12 is fastened about one end of the packaging material 10. The packaging material 10 is then ready to receive a product such as a ham or turkey or any other bulk material (see FIG. 1). Such a product is illustrated as the product 14, which is inserted into the sleeve 10 after the end is sealed by means of a clip 12, for example. Typically, the clip 12 may be of the type shown in U.S. Pat. No. 3,400,433 or U.S. Pat. No. 3,266,138 and may be applied by means of a double clipper mechanism, for example, of the type shown in U.S. Pat. No. 3,728,773.

Continuing to refer to FIG. 1, there is illustrated in schematic form a first clipper 16 and a second clipper 18. The first and second clippers 16 and 18 are separated from one another and define an axis 20. The clippers 16 and 18 are mounted on a base plate assembly and, as previously mentioned, may be of the type disclosed in U.S. Pat. No. 3,728,773. They are designed to attach U-shaped metal clips about gathered packaging material. Specifically, a U-shaped metal clip is driven by a punch into engagement with a die and thus forms about the packaging material. Typically, in a double clipper, after the clips are attached to the flexible packaging material, the material between the clippers along the axis 20 is cut to thereby separate adjacent packages.

The improvement of the present invention adds the following features to a prior art double clipper mechanism. First, a wrapping post 22 is positioned intermediate the clippers 16 and 18 on the forward side thereof for ease of access by a worker which is utilizing the equipment. The post 22 is on an extensible bracket 24 which permits the post 22 to move toward and away from the clippers 16 and 18. Second, a second fixed post 26 may be attached to the plate or frame associated with the second clipper 18. The purpose and use of the second post 26, as well as the post 22 will become apparent as set forth below.

Figure 2:
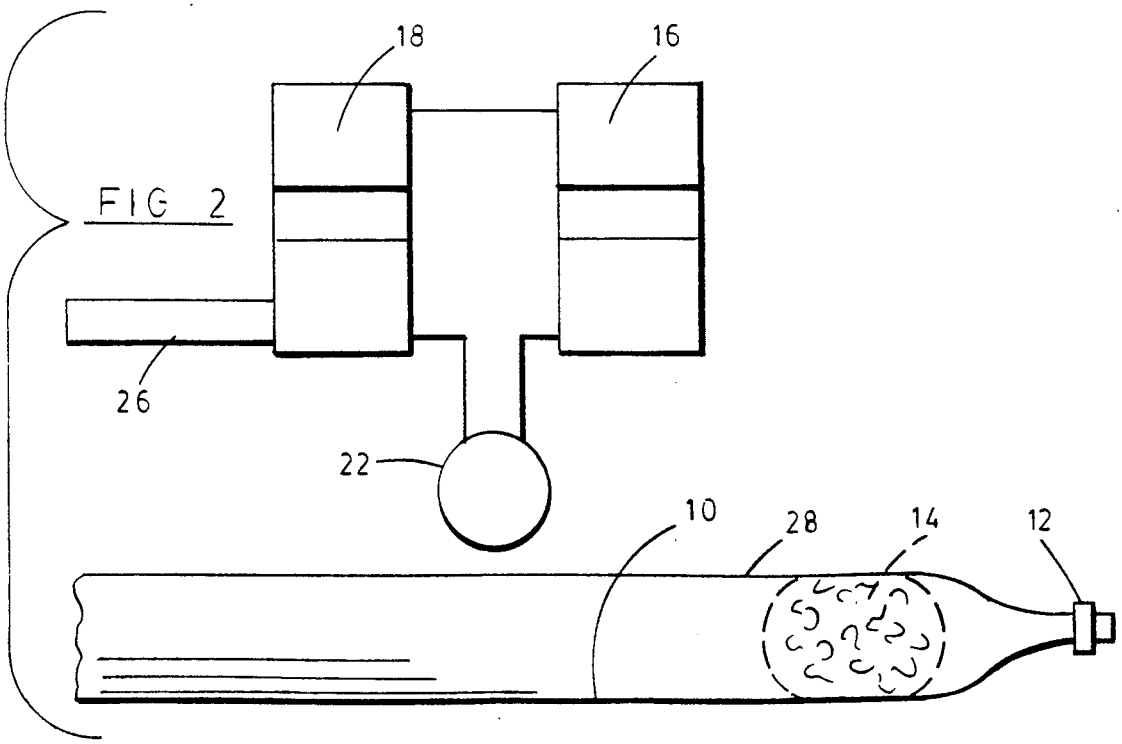
Figure 3:
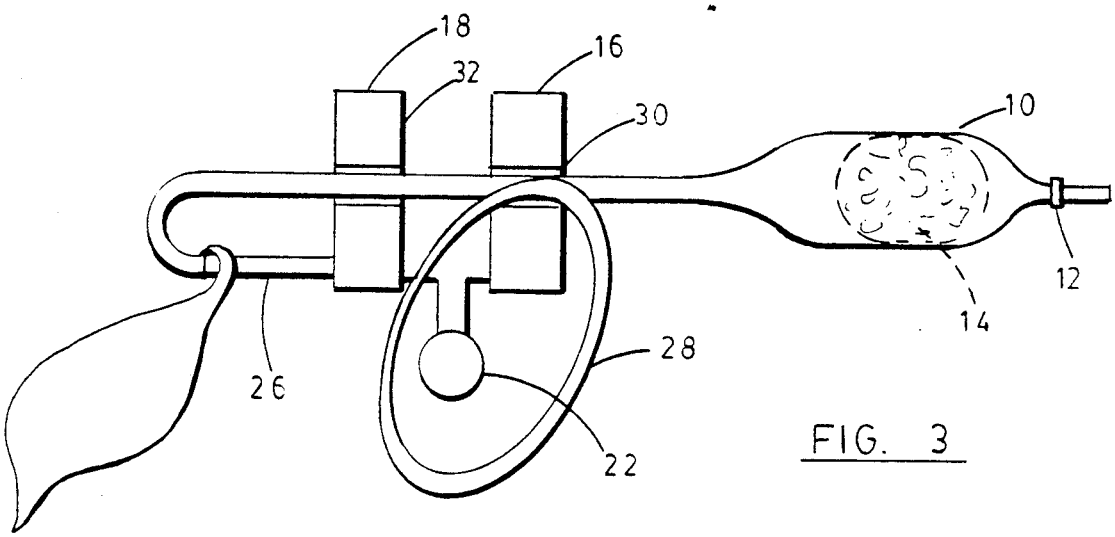

Referring next to FIG. 2, the packaging material 10 with the packaged product 14 therein is next moved so that the free end 28 of the packaging material 10, is more nearly adjacent the clippers 16 and 18 for cooperation therewith and for cooperation with the post 22, as well as the second post 26. Subsequently, as will be seen by reference to FIG. 3, the free end 28 is gathered and is initially fitted through the throat 30 associated with the first clipper 16. The free end 28 is then looped about or over the post 22 which, as shown in FIG. 3, is maintained in a "retracted" position. The free end 28 then is passed once again through the throat 30 and then through the throat 32 associated with the second clipper 18. Thereafter, the free end 28 is wrapped over the post or stud 26. Note that the post or stud 26 is an optional feature of the invention and may or may not be included or necessary. Also, note that the free end of the packaging material 10 is still connected with an integral part of the packaging material 10. It has not yet been severed.

Figure 4:
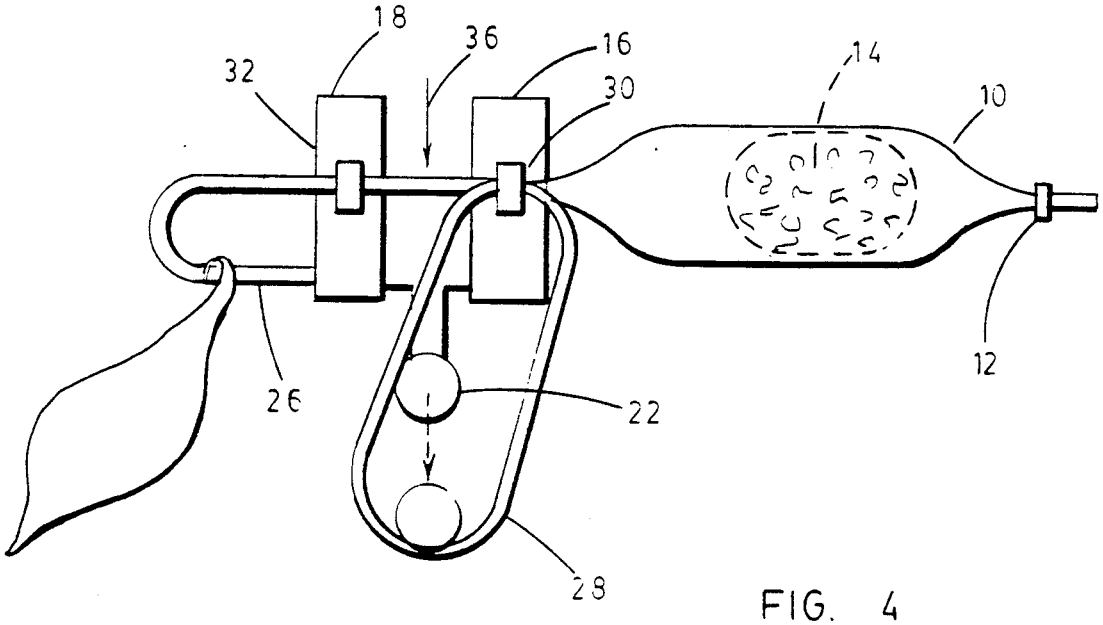

After the operator gathers and positions the free end as described and positions it through the throat of clipper 16 and about the post to 22, through the throat 32 of second clipper 18, and then about the post 26, the next step in the procedure occurs. Specifically, as shown in FIG. 4 the sleeve or post 22 extends by operation of a piston which supports the post 22. Such movement of the post to 22 will cause the tail end 28 to be pulled through the throat 30 associated with the first clipper 16, thereby tightly drawing the flexible packaging material 10 about the product 14 or contents therein. The portion of the free end 28 which extends through the throat 32 associated with the second clipper 18 will not be moved and slip because it is wrapped around the post 26. Moreover, the friction associated with the throats 30 and 32 generally results in sliding of the free end 28 through the throat 30 as the post 32 is extended in the manner shown. After the free end 28 is extended in the manner shown and the product 14 is tightly compressed within the flexible packaging material 10, clips are attached about the free end at the throat 30 and also at the throat 32. It should be noted that the clips attached about the free end 28 at the throat 30 will fit over a double thickness of the free end 28 because of the manner in which the assembly is wrapped and guided therethrough. The clip associated with the throat 32 will fit over a single gathered end 28 of the material 10.

The next step in the continued operation of the method of the invention is for a knife 36 to sever the free end 28 intermediate the throat 30 and 32 along the axis 20. In this manner, referring to FIG. 5, there is formed a separate packaged product 10A. Upon actuation of the knife 36 and cutting of the free end 28, the post 22 is retracted to its original position as depicted in FIG. 5. Upon such retraction, the loop formed by the free end associated with the contents of the now newly formed separate package, 10A in FIG. 5, may be utilized to lift and move the package 10A. A new sealed end associated with the packaging material 10 is then made available for a continuation of the same cycle of operations.

With the method steps performed as described, it will be noted that the operator need not pull and restrain the free end 28 manually in order to tightly pack the contents of the product 14 into the flexible packaging material 10. In the prior art, such a manual pulling operation was required and tension was required to maintain the contents tightly as the product 14 was sealed by the clipping operation. Previously, before the utilization of the first post 22 and optional second post 26, operators could develop carpal tunnel syndrome. With the methodology of the present invention, however, the likelihood of such an injury is greatly diminished. Moreover, the formation of a uniform loop for carrying the packaged product 14 is assured.

Figure 6:
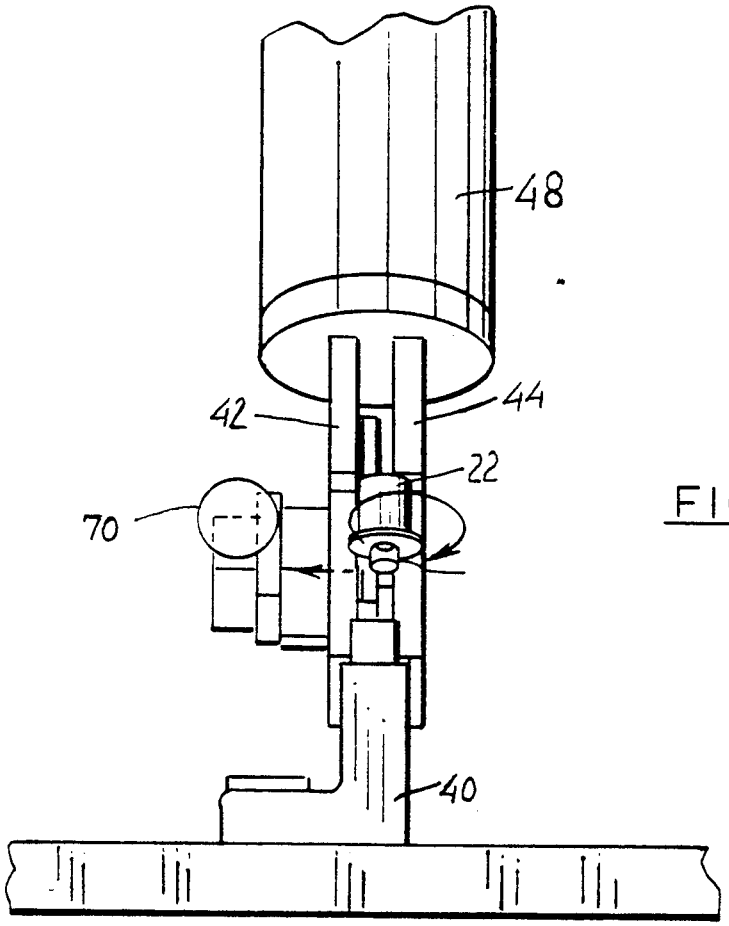
FIG. 6 is a front elevation of the invention illustrating the manner of attachment of the free end of the flexible packaging material through the clippers.

FIG. 6 depicts a front elevation of the arrangement of the tail end 28 just prior to the clipping sequence described. The arrow illustrates the path of movement of tail 28 as positioned over and around post 22 and through throats 30, 32.

Figure 9:
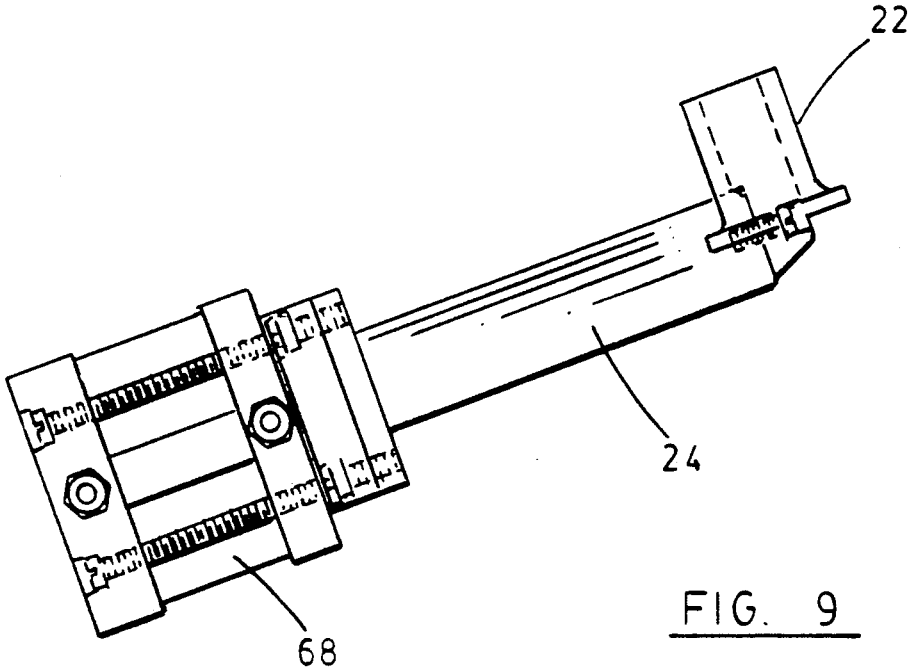
FIG. 9 is an enlarged elevational detail of the improved extendable first post construction associated with the method and apparatus of the invention.
Figure 7:
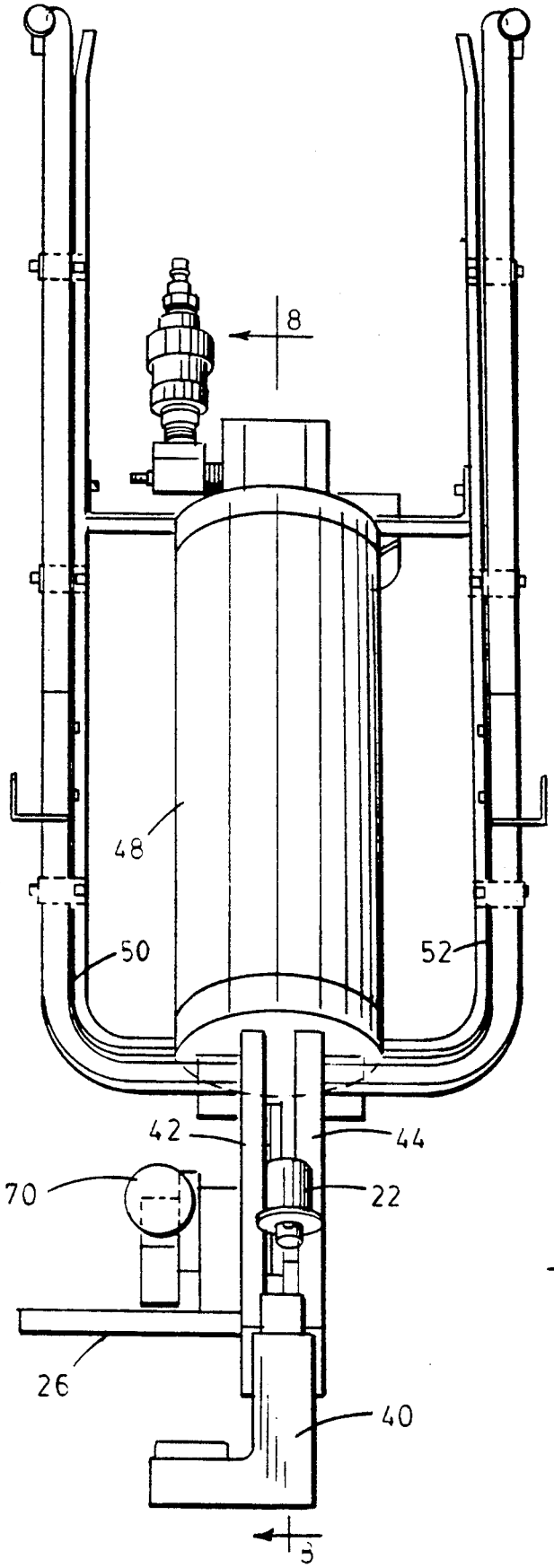
FIG. 7 is front elevation of the improved apparatus of the present invention.
Figure 8:
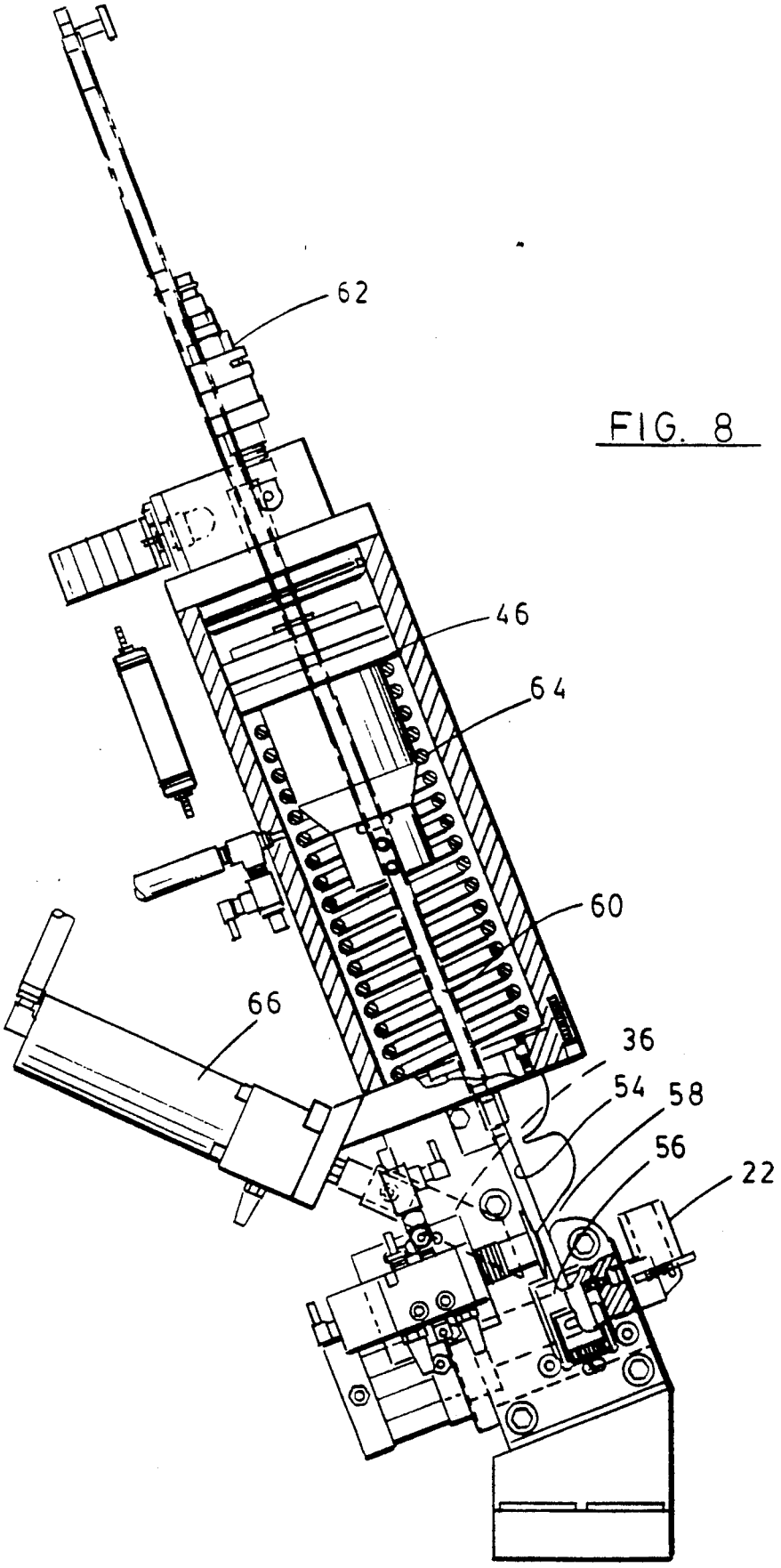
FIG. 8 is a partial side cross-sectional view of the invention taken substantially along the line 8—8 in FIG. 7.

FIGS. 7 through 9 illustrate in greater detail the construction of the double clipper of the invention which is used in the packaging sequence described previously. A base 40 supports separate die plates 42 and 44. Each die plate 42 and 44 is associated with a separate punch driven by a piston 46 associated with cylinder 48 for the simultaneous driving of two clips from rails 50 and 52 down punch channels, such as a channel 54, into engagement with a die 56 to thereby be formed about gathered material which has been positioned through a throat 58. Thus, each of the clippers generally has the same punch configuration as shown in cross-section in FIG. 8 for driving a clip. A punch 60 in FIG. 8, is moved in response to air pressure through air inlet 62 to drive a clip in the manner described. A compressible spring 64 returns the piston 46 to its normal rest position. A knife 36, as shown in FIG. 7, is also mounted on die support 42 and is driven by a cylinder 66 to sever gathered material in the manner described previously.

An important element of the invention is the sleeve or post 22, which is mounted on a bracket 24, which is, in turn, connected to an air cylinder 68. The air cylinder 68 is mounted on the base 40 intermediate the die support plates 42 and 44. A rod associated with the piston of the cylinder 68 attaches to the bracket 24. In this manner, as the piston moved in the cylinder 68, the bracket 24 may be extended or retracted to thereby extend or retract the sleeve or post 22.

As shown in FIG. 7, a second wrapping post 26 is attached to die support plate 42. A control knob 70, is mounted adjacent plate 42 and may be manually engaged to initiate the sequence of operation of the clippers and post 22. Thus, manually engaging the control 70 will initiate operation of the cylinder 68 to thereby extend bracket 24 and the sleeve or post 22. Subsequently and sequentially, the piston 46 is actuated to drive each punch, i.e. punch 60 and its companion parallel punch (not shown) into engagement with the clips to be formed about the tail end 28. Both of the clippers, 16 and 18 in the figures, are thus operated in the manner previously described. Subsequent to attachment of clips to the tail end 28 as described, the knife cylinder 66 is actuated to thereby cause the knife 36 to sever the tail end 28 intermediate the attached clips. Next the cylinder 68 is actuated to permit retraction of the bracket 24 and post 22. This permits release of the formed loop and the package 10A as depicted in FIG. 5. The construction is then ready for the next sequential operation.

While there has been set forth a preferred embodiment of the invention, it is to be understood that the invention is to be limited only by the following claims and their equivalents.

What is claimed is:

1. An improved method of packaging with flexible packaging material using a clipper of the type having two spaced clippers for simultaneously attaching first and second spaced U-shaped metal clips to gathered packaging material, each clipper of the type including a throat for receipt of gathered packaging material, a die at one end of the throat and a punch for engaging a clip against a die and around the packaging material, said method comprising the steps of:

filling the packaging material from an open end thereof with a product to provide a tail of packaging material at the open end;

positioning the tail through the throat of one of the clippers thence around a movable post between the clippers, and thence again through the throat of the one clipper and subsequently through the throat of the other clipper;

moving the post to pull the tail tightly into the throat of the one clipper while maintaining the position of the tail in the throat of the other clipper to thereby tightly wrap the packaging material about the product by drawing the material through the throat of the one clipper;

subsequently substantially simultaneously attaching clips to the tail through the throat of each clipper to form a loop for the packaged product; and severing the unlooped part of the tail between the clippers to provide a separate tightly packaged product with a loop at one end of the packaging material and to further provide a separate first closed end of packaging material.

2. An improved apparatus for forming a loop on the free end of a package of a product in a flexible packaging material and for assisting in tightly packaging the product in the flexible packaging material, said apparatus comprising, in combination;

first and second spaced clippers, each clipper of the type having a throat for receipt of the flexible packaging material, a die and a punch for directing a U-shaped metal clip about the packaging material;

a cutting device between the clippers for severing packaging material extending there between;

a first post mounted adjacent the dies of the clippers and intermediate the clippers for wrapping the free end of packaging material thereon;

a bracket for support of the first post;

means for extending the bracket and moving the first post away from both dies of the clippers to pull the free end of packaging material through the throat of one clipper and thereby more tightly wrap the packaged product before attachment of a clip to minimize manual pulling on the free end of the packaging material.

3. The apparatus of claim 2 including a second post for wrapping the free end of the packaging material which is fitted through the throat of both clippers.

4. The apparatus of claim 2 wherein the first post is mounted on a piston extensible bracket.

* * * * *